US006672282B2

(12) United States Patent
Harrison et al.

(10) Patent No.: US 6,672,282 B2
(45) Date of Patent: Jan. 6, 2004

(54) INCREASED RESOLUTION ELECTRONIC THROTTLE CONTROL APPARATUS AND METHOD

(75) Inventors: Clive Oliver Neal Harrison, Chelmsford (GB); Ross Dykstra Pursifull, Dearborn, MI (US); Dennis McDonald, Canton, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 57 days.

(21) Appl. No.: 10/093,282

(22) Filed: Mar. 7, 2002

(65) Prior Publication Data

US 2003/0168042 A1 Sep. 11, 2003

(51) Int. Cl.[7] ..... F02D 11/00
(52) U.S. Cl. ..... 123/399
(58) Field of Search ..... 123/399, 361; 701/101, 102, 115

(56) References Cited

U.S. PATENT DOCUMENTS

| | | | | |
|---|---|---|---|---|
| 4,951,209 A | | 8/1990 | Nagaishi et al. | 701/102 |
| 5,025,380 A | | 6/1991 | Wataya et al. | 701/103 |
| 5,293,553 A | | 3/1994 | Dudek et al. | 701/102 |
| 5,524,724 A | | 6/1996 | Nishigaki et al. | 180/176 |
| 5,602,732 A | * | 2/1997 | Nichols et al. | 701/29 |
| 5,746,178 A | | 5/1998 | Susaki et al. | 123/399 |
| 5,781,875 A | | 7/1998 | Maki et al. | 701/104 |
| 5,852,996 A | * | 12/1998 | Nakamura et al. | 123/399 |
| 5,875,762 A | | 3/1999 | Tsuchiya et al. | 123/399 |
| 5,931,138 A | | 8/1999 | Uchida | 123/436 |
| 6,006,724 A | | 12/1999 | Takahashi et al. | 123/339.19 |
| 6,092,018 A | | 7/2000 | Puskorius et al. | 701/110 |
| 6,182,635 B1 | | 2/2001 | Nishida | 123/399 |
| 6,397,816 B1 | * | 6/2002 | Pursifull | 123/399 |
| 6,414,607 B1 | * | 7/2002 | Gonring et al. | 341/20 |
| 2003/0098013 A1 | * | 5/2003 | Pursifull et al. | 123/399 |

FOREIGN PATENT DOCUMENTS

| | | | | |
|---|---|---|---|---|
| DE | 4226309 | * | 2/1994 | F02D/11/10 |
| EP | 1199455 A | | 4/2002 | |
| FR | 2672639 A | | 8/1992 | |
| JP | 2002-138858 A | | 5/2002 | |

* cited by examiner

*Primary Examiner*—Henry C. Yuen
*Assistant Examiner*—Hai Huynh
(74) *Attorney, Agent, or Firm*—MacMillan, Sobanski & Todd LLC

(57) ABSTRACT

An apparatus and method for controlling a throttle of an electronic throttle control-equipped engine including providing a throttle position feedback signal as a function of integer counts, each of the counts representing a resolution of a predetermined angle of actual throttle position, providing a desired throttle position command as a setpoint value being a function of half counts and generating an error signal representing a difference between the desired throttle position command value and the throttle position feedback signal value. A relay output signal is generated in response to the error signal, the relay output signal having one of two values depending upon a sign of the error signal and a direction of change of the error signal. A throttle actuator command is then generated as a function of the relay output signal value having a half count resolution.

8 Claims, 5 Drawing Sheets

| Position Sensor Feedback | | | | |
|---|---|---|---|---|
| A to D Output (counts) | Sensor Output Band (volts) | | Angle Band (degrees) | |
| | begin | end | begin | end |
| 0 | 0.000 | 0.005 | 0 | 1/16 |
| 1 | 0.005 | 0.010 | 1/16 | 2/16 |
| 2 | 0.010 | 0.015 | 2/16 | 3/16 |
| . | . | . | . | . |
| . | . | . | . | . |
| . | . | . | . | . |
| 220 | 1.100 | 1.105 | 27 8/16 | 27 9/16 |
| 221 | 1.105 | 1.110 | 27 9/16 | 27 10/16 |
| 222 | 1.110 | 1.115 | 27 10/16 | 27 11/16 |
| . | . | . | . | . |
| . | . | . | . | . |
| . | . | . | . | . |
| 1022 | 5.110 | 5.115 | 63 14/16 | 63 15/16 |
| 1023 | 5.115 | 5.120 | 63 15/16 | 64 |

Table 1

| Sign Function | | | Relay Function | |
|---|---|---|---|---|
| input | output | | input | output |
| -3 | -1 | ↓ | -3 | -1 |
| -2 1/2 | -1 | ↓ | -2 1/2 | -1 |
| -2 | -1 | ↓ | -2 | -1 |
| -1 1/2 | -1 | ↓ | -1 1/2 | -1 |
| -1 | -1 | ↓ | -1 | -1 |
| -1/2 | -1 | ↓ | -1/2 | -1 |
| 0 | 0 | ↓ | 0 | -1 |
| 1/2 | +1 | ↓ | 1/2 | +1 |
| 1 | +1 | ↓ | 1 | +1 |
| 1 1/2 | +1 | ↓ | 1 1/2 | +1 |
| 2 | +1 | ↓ | 2 | +1 |
| 1 1/2 | +1 | ↓ | 1 1/2 | +1 |
| 2 | +1 | ↓ | 2 | +1 |
| 2 1/2 | +1 | ↓ | 2 1/2 | +1 |
| 3 | +1 | ↓ | 3 | +1 |
| 2 1/2 | +1 | ↓ | 2 1/2 | +1 |
| 2 | +1 | ↓ | 2 | +1 |
| 1 1/2 | +1 | ↓ | 1 1/2 | +1 |
| 1 | +1 | ↓ | 1 | +1 |
| 1/2 | +1 | ↓ | 1/2 | +1 |
| 0 | 0 | ↓ | 0 | +1 |
| -1/2 | -1 | ↓ | -1/2 | -1 |
| -1 | -1 | ↓ | -1 | -1 |
| -1 1/2 | -1 | ↓ | -1 1/2 | -1 |
| -2 | -1 | ↓ | -2 | -1 |
| -2 1/2 | -1 | ↓ | -2 1/2 | -1 |
| -3 | -1 | ↓ | -3 | -1 |

Table 2

Fig. 5

INCREASED RESOLUTION ELECTRONIC THROTTLE CONTROL APPARATUS AND METHOD

FIELD OF THE INVENTION

The present invention is directed to a control system and method for internal combustion engines, and more particularly, concerns a throttle position control scheme for electronic throttle control-equipped vehicles.

BACKGROUND OF THE INVENTION

Electronic airflow control systems such as electronic throttle control systems, replace traditional mechanical throttle cable systems with an "electronic linkage" provided by sensors and actuators in communication with an electronic controller. This increases the control authority of the electronic controller and allows the airflow and/or fuel flow to be controlled independently of the accelerator pedal position. Electronic throttle control systems include mechanisms for positioning the throttle plate in response to the driver demand and other vehicle system constraints such as a traction control system.

The most common positioning mechanism is a positioning motor. A closed-loop feedback position controller typically responds to a discrete throttle position value and commanded throttle position. Because the feedback signal is an analog signal that has been discretized by an analog-to-digital converter, its resolution is quantized and may not precisely correspond to a commanded steady-state throttle position. Thus, there is a need for an improved throttle position control system and method.

SUMMARY OF THE INVENTION

Electronic Throttle Control (ETC) sets the airflow rate into the engine during idle speed control by controlling the throttle to a precise angle. The vehicle manufacturer would like as fine of positional resolution as possible from the ETC system because it provides fine airflow rate control enabling the manufacturer to markedly improve idle speed control. Classic methods to achieve this goal are costly (e.g. 12 bit A to D, progressive throttle bore). The ETC according to the present invention solves the problem within the micro-controller itself thus yielding a software-only (no variable cost) solution. By forcing the controller into a very specific limit cycle pattern, it can be made to achieve an average position that is of a higher resolution than if it were not to fluctuate. Its limit cycle frequency is high enough to where the fluctuation does not degrade airflow rate control. It in fact improves resolution. Typical systems have 1/9 or near 1/10 degree resolution. With the system according to the present invention the resolution is improved to 1/18 or nearly 1/20 degree resolution. In a system that has a natural resolution of 1/16 degree, the resolution is improved to 1/32 degree.

The system according to the present invention is a feedback position control system. Feedback is provided by a potentiometer-type throttle position sensor. Via circuitry, the sensor inputs a ratiometric voltage at the micro-controller's analog-to-digital (A to D) input. The controller reads this feedback sensor output as A to D counts (0 to 1023 in this case). Each one of those counts corresponds to a voltage range. If the A to D's reference voltage is 5.120 volts, each voltage range is nominally 0.005 volts. Each of these voltage ranges corresponds to an angle range. Using a throttle position sensor with an output gain of +16 counts per degree, each A to D count corresponds to a small band of throttle angles that is 1/16 degree wide.

If the controller is controlling to a steady A to D count value, the actual position is wandering around in that 1/16 degree range. The system according to the present invention eliminates this wandering problem (i.e. uncertainty in actual position) and others by using a limit cycle to force the actual throttle position to continually cross an A to D boundary. For example, the controller carefully quantizes the setpoint value to be ½ counts (e.g. −½, +½,+1½, +2½, +3½, . . . ). In this way the actual position continually crosses the A to D boundary in a limit cycle and achieves a very repeatable position.

The system according to the present invention preserves all the advantages of the above-described system and adds another feature. That feature is the ability to increase the resolution by a factor of two such that the previous resolution of 1/16 degree is improved to 1/32 degree.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which:

FIG. 5 is a table of sign function values versus relay function values; and

DESCRIPTION OF THE PREFERRED EMBODIMENT

Figure 1:
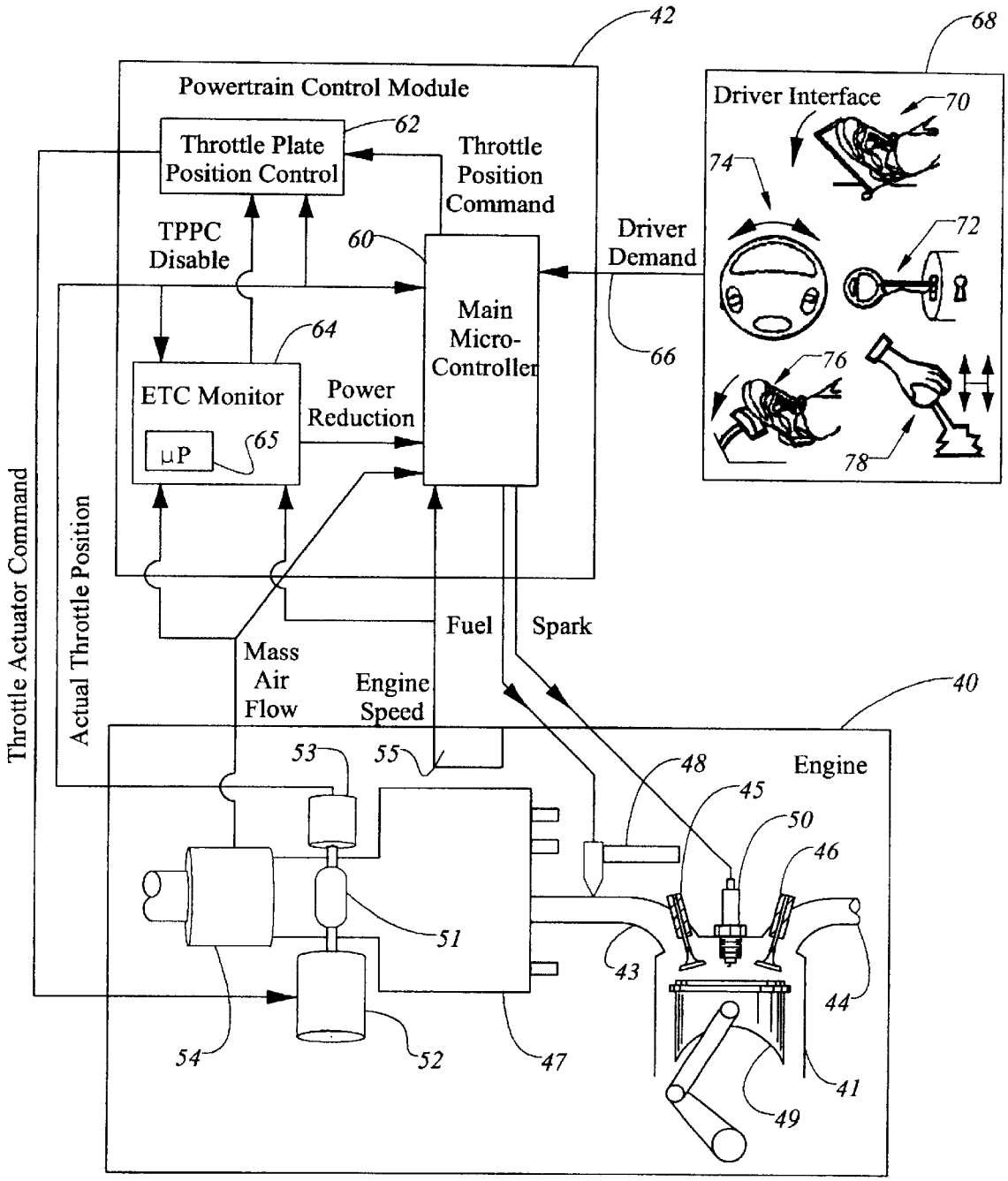
FIG. 1 is a schematic diagram of an internal combustion engine and associated electronic throttle control and operator input systems in accordance with the present invention.

Referring now to FIG. 1, there is shown a schematic diagram of an internal combustion engine 40 and an associated Powertrain Control Module (PCM) 42 as well as an operator interface 68 in accordance with the present invention. The engine 40 includes a plurality of combustion chambers 41 each having an associated intake 43 and an associated exhaust 44 operated by respective intake and exhaust valves 45, 46. Combustion occurs as a result of the intake of air and fuel from an intake manifold 47 and a fuel injector 48 respectively, compressed by a piston 49 in the chamber 41, and ignited by a spark plug 50. Combustion gases travel through the exhaust manifold 44 to a downstream catalytic converter (not shown) and are emitted out of a tailpipe. A portion of the exhaust gases may also be recirculated back through the intake manifold 47 to the engine cylinders 41.

The airflow through the intake manifold 47 is controlled by a throttle comprising a throttle plate 51 and a throttle actuator 52. The throttle actuator is preferably an electronic servomotor. A throttle position sensor 53 measures the actual throttle position. The throttle position sensor is typically an analog sensor. An output signal of the sensor 53 passes through an analog-to-digital converter (not shown) to generate to the PCM 42 discrete positional values for the detected throttle position. Thus, the quantization of the positioning mechanism is typically a function of the resolution of the A to D converter. However, higher resolution typically is associated with higher cost A to D converters.

Other sensors include a mass airflow sensor 54 that measures the amount of air flowing into the engine 40. An engine speed sensor 55 provides a value indicative of the rotational speed of the engine 40.

The PCM 42 receives as inputs the actual throttle position signal, the mass airflow signal, the engine speed signal, and any driver demand inputs, among other things. In response, the PCM 42 controls the spark timing of the spark plugs 50, the pulse width and timing of the fuel injectors 48, and the position of the throttle 51 by way of the throttle actuator 52. These inputs and outputs are controlled by a main micro-controller 60. The main micro-controller 60 controls the throttle position by outputting a throttle position command to a Throttle Plate Position Controller (TPPC) 62 to drive the throttle actuator 52 to the desired position with a throttle actuator command, as will be described in more detail below.

The TPPC 62 is preferably a PID controller that closed-loop controls the throttle position based primarily on an error term representing the difference between the desired and actual throttle position values. The desired throttle position can be generated by any known methods of interpreting driver demand and arbitrating it with the various vehicle system constraints such as speed control and traction control. The resulting desired intake airflow value is then factored into a formula to yield a desired throttle position command.

With regard to throttle control, the PCM 42 generates a throttle position command. The desired throttle position command is communicated to the TPPC 62. The TPPC 62 preferably conditions the throttle position command and communicates this signal to the closed-loop controller that is part of the TPPC 62. The closed-loop controller outputs a drive signal to the throttle actuator 52 to drive the throttle 51 to the desired position.

The PCM 42 preferably includes an Electronic Throttle Control (ETC) monitor 64 that communicates with the main micro-controller 60 and the TPPC 62. The ETC monitor 64 includes a microprocessor 65 and an associated memory separate from the microprocessor and the main micro-controller 60. The ETC monitor 64 receives as inputs the engine speed signal from the engine speed sensor 55 and the throttle position signal from the throttle position sensor 53. The ETC monitor 64 then functions to monitor the throttle actuation. Although the ETC monitor 64 and the TPPC 62 are shown as separate from the main micro-controller 60, they could be partially or wholly integrated into the main micro-controller as well. Alternatively, the ETC monitor 64 and the TPPC 62 can be integrated into a single controller separate from the main micro-controller 60.

The PCM 42 also receives as inputs driver demand signals 66. The driver demand signals can include such things as an accelerator pedal position 70, an ignition switch position 72, a steering input 74, a brake sensor input 76, a transmission position input 78, as well as inputs from the vehicle speed control and transmission.

A method of controlling the throttle position begins by determining the desired throttle position. The desired throttle position command is preferably derived by the PCM 42 and communicated to the TPPC 66. A desired or commanded throttle position can be generated by any known method, but typically is a function of the accelerator pedal position input by the operator, the engine speed, the engine coolant temperature, barometric pressure, and air charged temperature. Given the driver demand, and any inputs from the speed control system and traction control system, if active, as well as any constraints imposed by engine, vehicle, or transmission speed limits, the PCM 42 generates a desired airflow value resulting in a desired throttle position to achieve that airflow. The throttle position command can be expressed in units of A to D counts or degrees.

Because the actual throttle position signal is discretized by an A to D converter, it necessarily discretizes the position information provided to the TPPC 62. Thus, even though the commanded throttle position may effectively be continuous within the controller, the achievable steady position is discretized. For example, the actual throttle position signal may only have a resolution of 1/16 degrees of throttle opening angle. If the desired throttle opening angle is 14 5/32 degrees, a steady-state condition may result when the actual throttle position sensor value reads 14 3/16 degrees due to the discrepancy and resolution between the position controller 66, and the position sensor 53.

Figures 2, 6:
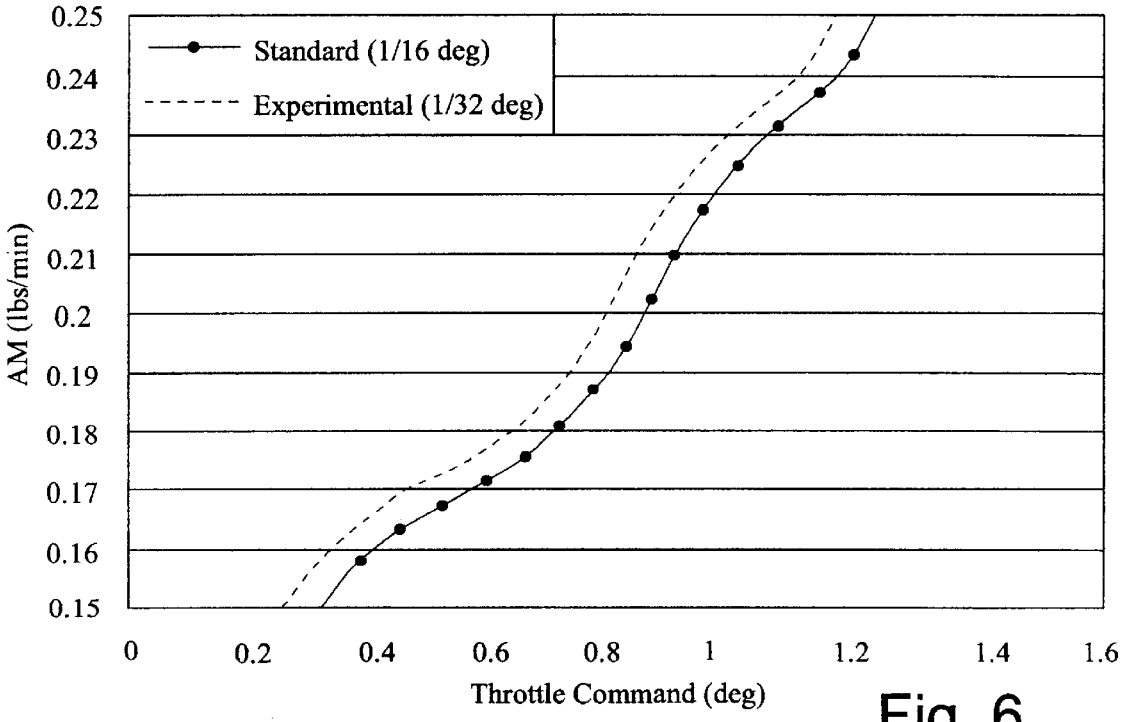
FIG. 2 is a table of position sensor output signal values and corresponding A to D converter output signal values used with the present invention.
FIG. 6 is a plot of air mass flow versus throttle command position for the controller according to the present invention.

FIG. 2 is a table (Table 1) of A to D output signal digital counts (left column) generated in response to the analog output signal of the position sensor 53 (middle column) and the corresponding position sensor angle (right column). If the controller 60 is arranged such that the feedback limit cycles between 220 and 221 counts, the average position attained is 27 19/32 degrees. If the feedback limit cycles between 221 and 222 counts, the average position attained is 27 21/32 degrees. The resolution of this system is one A to D count which equals 1/16 degree.

The system according to the present invention preserves all the advantages described above and adds another feature. That feature is the ability to increase the resolution by a factor of two. In the above-described system, the resolution is 1/16 degree. With the improved system described below, the resolution is improved to 1/32 degree.

The first step to increase the resolution is to quantize the throttle position command (in counts) like so: {0, ½, 1, 1½, 2, 2½, . . . 1023}. Now if the controller is not modified, the proper result is not obtained. When the setpoint is an integer number of A to D counts (221 in this example), wandering within an A to D voltage division will occur (between 220½ and 221½ as shown in FIG. 3*d*).

Figure 4:
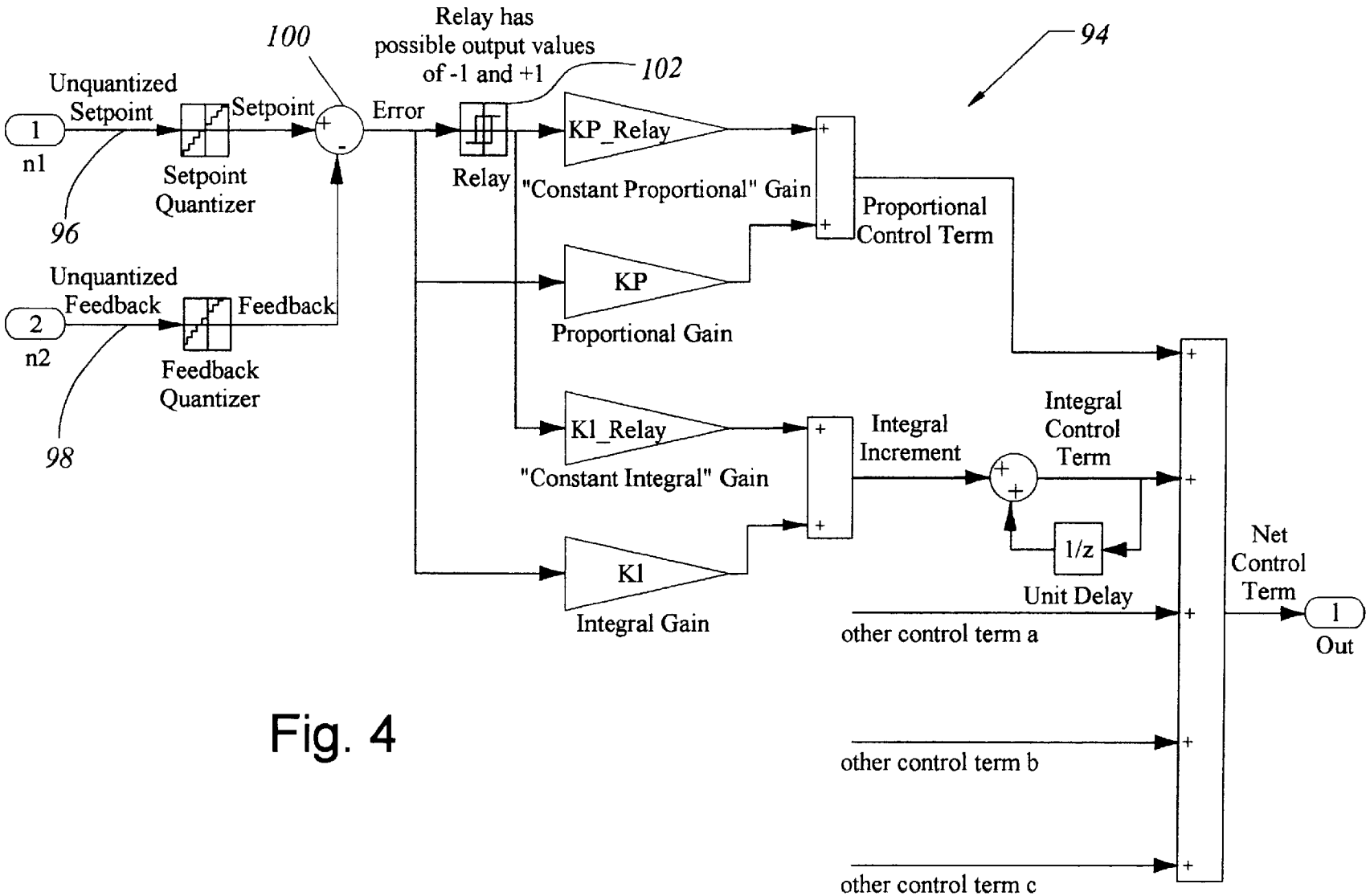
FIG. 4 is a schematic block diagram of the main micro-controller according to the present invention.

To avoid this behavior and obtain the behavior according to the present invention, one block is replaced in the schematic block diagram of the controller 60. There is shown in FIG. 4 a main micro-controller 94 having a setpoint signal input line 96 and a feedback signal input line 98. A summing point 100 receives the setpoint signal and the feedback signal to generate an error signal to an input of a relay function block 102 having two opposite output signal values (+1, −1). The relay function block 102 replaces a sign function block (not shown) in the main micro-controller 60, the sign function having output values (+1, 0, −1). The output signal values of the sign function and the relay function are compared in FIG. 5 (Table 2). Note that the relay function is direction dependent and the sign function is not.

Figure 3A:
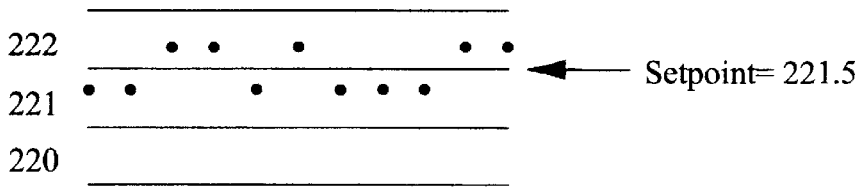
FIGS. 3*a* to 3*d* are plots of various micro-controller output signals.
Figure 3B:
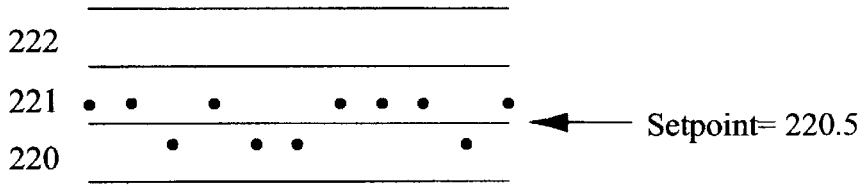
Figure 3C:
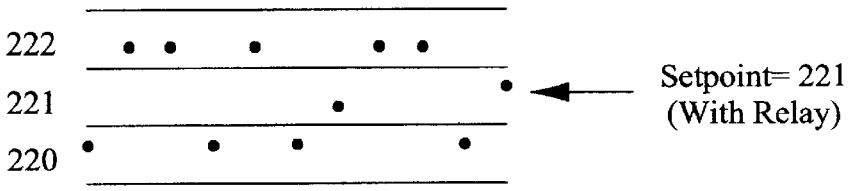
Figure 3D:
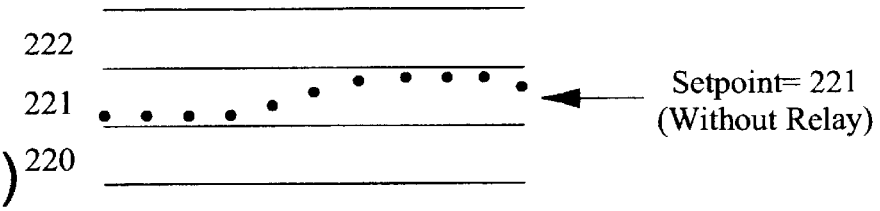
Fig. 3d (Prior Art)

FIGS. 3*a*–3*d* illustrate the performance of various forms of micro-controllers. In FIG. 3*d*, there is shown the classic but generally completely undetected (or more likely, improperly assigned) behavior problem with feedback controllers of this sort. Since the A to D region covers a band of actual positions, the best the controller can do is to control to somewhere within that range causing poor repeatability and poor fine motion control. The FIGS. 3*a* and 3*b* show the operation of the above-described system using the sign function block that has effectively flawless repeatability and the fine motion control is only limited by the Differential Non-Linearity (DNL) of the A to D converter. The setpoint is generated in half counts with FIG. 3*a* showing a 221½ setpoint and FIG. 3*b* showing a 220½ setpoint. The resolution is a very predictable 1 count (1/16 degree in this case).

The behavior of the controller 94 according to the present invention is the same as is shown in FIGS. 3*a* and 3*b* where the setpoint is in half-counts. However, the controller 94 according to the present invention can also work in the mode shown in FIG. 3*c* yielding all the advantages of the controller with the sign function block, but with additional resolution. The resolution is a very predictable ½ count (1/32 degree in this case) with an integer setpoint of 221.

FIG. 6 is a plot of air mass flow versus the throttle command in degrees for a test of the PCM 42 according to the present invention. The objective is to control to a very precise average throttle position and thus effect a very precise air flow. The graph shows that the controller effectively "splits the difference" and improves resolution from 1/16 degree to 1/32 degree. The controller according to the present invention has improved performance because the oscillation between two A to D values (not necessarily adjacent) happens at the natural limit cycle of the controller. Fast cycling further decouples the throttle plate positional noise from the engine performance.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. A method for controlling a throttle of an electronic throttle control-equipped engine comprising the steps of:

a. providing a throttle position feedback signal as a function of integer counts, each of the counts representing a resolution of a predetermined angle of actual throttle position;

b. providing a desired throttle position command as a setpoint value being a function of half counts;

c. generating an error signal representing a difference between the desired throttle position command value and the throttle position feedback signal value;

d. generating a relay output signal in response to the error signal, the relay output signal having one of two values depending upon a sign of the error signal and a direction of change of the error signal; and e. generating a throttle actuator command as a function of the relay output signal value and having a half count resolution.

2. The method according to claim 1 including a step of communicating the throttle position command to a throttle plate position controller.

3. The method according to claim 1 wherein the step a. includes generating a +1 value for a positive sign error signal and generating a −1 value for a negative sign error signal.

4. The method according to claim 3 wherein the step a. includes generating a +1 value when the value of the error signal changes from a positive sign to zero and generating a −1 value when the value of the error signal changes from a negative sign to zero.

5. A throttle position control system for an internal combustion engine comprising:

an electric motor responsive to a throttle actuator command signal for actuating the position of a throttle coupled to said motor;

a throttle position sensor for detecting an actual position of the throttle and generating a throttle feedback position signal within a first resolution value; and a controller for generating said throttle actuator command signal as a function of a desired throttle position signal and said throttle position feedback signal, said throttle actuator command signal having a second resolution value which is greater than said first resolution value.

6. The throttle position control system according to claim 5 wherein said controller includes a relay function responsive to an error signal representing a difference between said desired throttle position signal and said throttle position feedback signal for generating a relay output signal, said throttle actuator command signal being a function of said relay error signal.

7. The throttle position control system according to claim 6 wherein said relay output signal is generated with a +1 value for a positive sign error signal and is generated with a −1 value for a negative sign error signal.

8. The throttle position control system according to claim 7 wherein said relay output signal is generated with a +1 value when the value of said error signal changes from a positive sign to zero and is generated with a −1 value when the value of the error signal changes from a negative sign to zero.

* * * * *